United States Patent [19]

Koch

[11] Patent Number: 4,657,282

[45] Date of Patent: Apr. 14, 1987

[54] SKI POLE HAND SHIELD

[76] Inventor: Jean Koch, 1635 Tillemont Street, Ville Brossard, Canada, J4W 2H9

[21] Appl. No.: 795,401

[22] Filed: Nov. 5, 1985

[51] Int. Cl.[4] ..... A63C 11/22

[52] U.S. Cl. ..... 280/821

[58] Field of Search ..... 280/821, 819, 289 H, 280/289 S; 74/551.8, 551.9; 296/78.1; 2/17, 164, 272

[56] References Cited

U.S. PATENT DOCUMENTS

| | | | |
|---|---|---|---|
| 3,746,356 | 7/1973 | Shipstad | 280/821 |
| 3,874,686 | 1/1975 | Shipstad et al. | 280/821 |
| 4,214,770 | 7/1980 | Agins | 280/819 |
| 4,343,490 | 8/1982 | Adamson | 280/821 |
| 4,583,247 | 4/1986 | Fingerhut et al. | 2/272 |

FOREIGN PATENT DOCUMENTS

| | | | |
|---|---|---|---|
| 944391 | 3/1974 | Canada | 280/821 |
| 1005477 | 2/1977 | Canada | 280/819 |
| 2357662 | 5/1975 | Fed. Rep. of Germany | 280/821 |

*Primary Examiner*—David M. Mitchell

[57] ABSTRACT

A shell composed of semi-rigid material which covers the top, the front, the sides and the bottom of the gloved hand of a skier when clenched on a ski pole hand-grip and which has a larger volume than the gloved hand when clenched on the hand-grip, so that the gloved hand does not come in contact with the shell. This shell being metallized inside with reflective material. The top part rises above the top of the hand-grip and is kept spaced from it through a spacer and is attached by way of a screw. The bottom part has a slanted surface toward the rear and the bottom and has a hole in it, which receives the ski pole, in order to attach the bottom part of the shell to the ski pole.

4 Claims, 8 Drawing Figures

FIG. 1
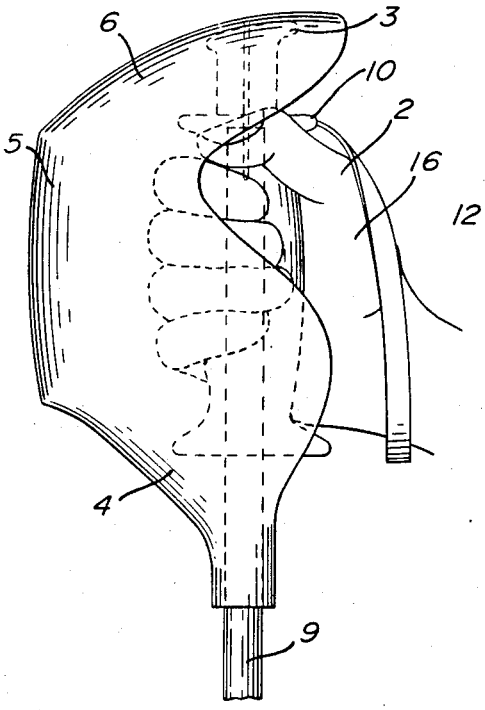
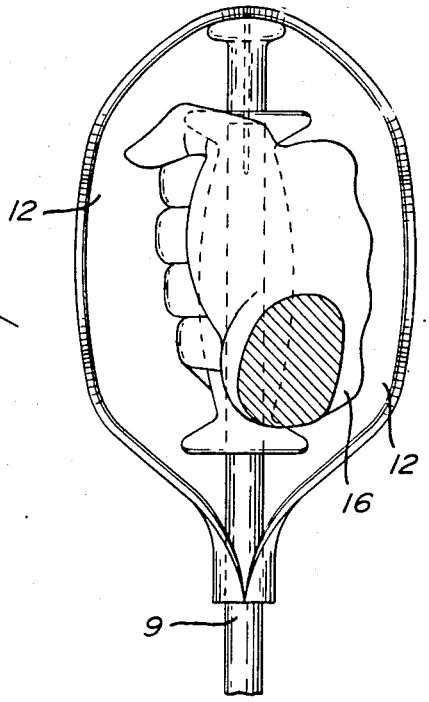
FIG. 3
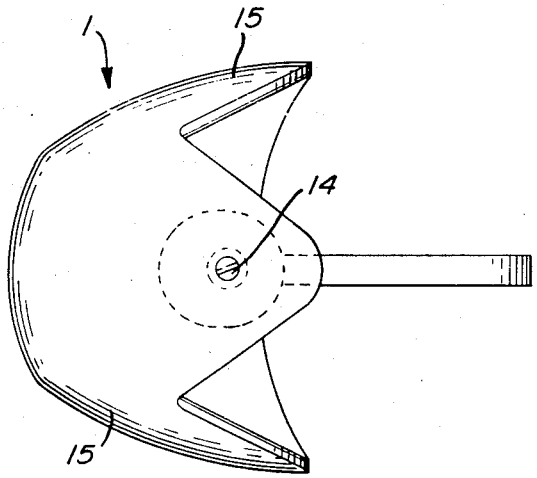
FIG. 2
FIG. 4
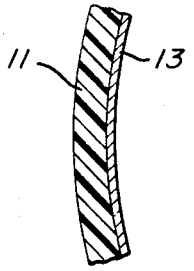

SKI POLE HAND SHIELD

BACKGROUND AND SUMMARY OF THE INVENTION

The invention herein is designed in view of preventing the skier hands of being frost bit by protecting the hand clenched on the pole hand-grip from the heat loss by radiation, convection and conduction.

The generally-known ski pole hand-grip leaves the hand or the gloved hand of a skier when clenched on the grip exposed to the wind. The proposed windshield will protect the hand or gloved hand from the wind chill effect or convection by acting as a barrier against wind and also to reflect the heat loss by radiation generated by the hand, toward the hand, since the interior of the shell will be metallised by a reflecting material which will not touch the gloved hand and also will protect the hand from the cooling effect by conduction in preventing the gloved hand of being in contact with a cold object.

The main difficulty of making such a product is in the moulding and the aerodynamics of the shell such that it can be easily installed on existing ski poles, and that it can permit the hand to easily release the hand-grip of the skit pole. Also, this shell shall not have sharp or cutting edges and shall have a shape that shall not permit the snow or water to accumulate in it, or to be retained in it, and it shall be shaped in view of emptying itself. The material used to make the shell should be semi-rigid, that is sufficiently rigid, so that the shell will keep its shape at a temperature of 70 degrees Fahrenheit and will also remain flexible at a temperature of minus 40 degrees Fahrenheit, so it will resist shocks without being rigid, brittle or cutting. The shell will also be of a minimum bulkiness but will leave sufficient clearing space around the gloved hand clenched on the hand-grip.

This shell will cover the top, the front, the bottom and partially the sides of the clenched gloved hand; it will leave the wrist completely free and clear from the enclosure at any time without having any mechanism related to the hand, or to the shell; it will not be detachable by the only action of the skier's hand and its position will be fixed or semi-fixed in relation to the hand-grip.

BRIEF DESCRIPTION OF THE ANNEXED DRAWINGS

FIG. 1 is the side view of the first embodiment of the ski pole hand shell and showing the skier's gloved hand clenched on the hand-grip;

FIG. 2 is the top view of FIG. 1;

FIG. 3 is a rear end view of FIG. 1, showing the volume or profile of the gloved hand on the grip;

FIG. 4 is an enlarged cross-section of the shell showing the inside coating;

DETAILED DESCRIPTION OF THE DRAWINGS

Figure 5:
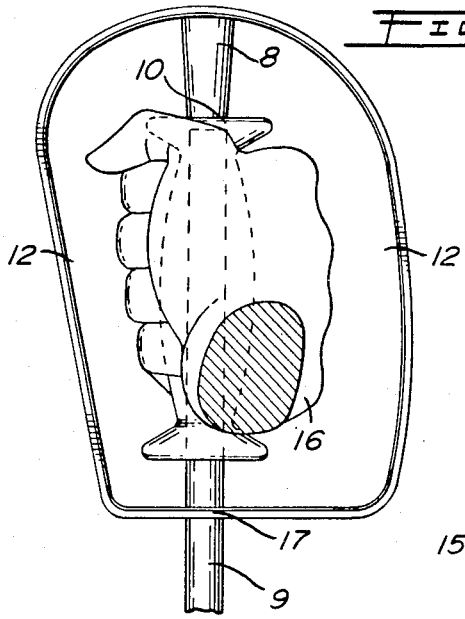
FIG. 5 is a rear end view of a second embodiment of the shell, suited for the right hand, and showing the volume of the clenched gloved hand and the top spacer member of the shell which is vacuum formed.

The hand shield of the invention is for use with a ski pole 9, having a removable frictional fit within a blind bore of a hand-grip 7. The shield of FIGS. 1 to 4 inclusive includes a shell 1, made of a semi-rigid plastic 11 which wraps all sides of the hand-grip 7, except for the rear 12 which is left open. The bottom part 4, which underlies the hand-grip, is downwardly and rearwardly sloped, which permits snow or water that could get in the shell after a ski fall, to drain itself. The bottom of the shell has a split hole 17 which forms a clip to snap around the tubular, metallic ski pole 9, in order to hold the shell to the pole at the bottom. The top part 6 of the shell 1 is upwardly, rearwardly sloped and rounded for deflecting the wind that will hit that part of the shell when the skier is on the move and has the pole slanted forward. This top part 6 is then riding in a vertical position and is then used as a shield, protecting therefore the top part 2 of the skier's clenched, gloved hand 16. The front part 5, the sides 15 of shell 1, and also its top part 6 are spaced from and do not touch the gloved skier's hand 16 clenched on the hand-grip 7. The top part 6 overhangs the top end 10 of the hand-grip 7 and is supported on it by a separate spacer 3, which lies on the top end 10 of hand-grip 7. A screw 14 extends through the top part 6 of shell and spacer 3 and is screwed within the top end 10 of hand-grip 7 and preferably also within a plug closing the upper end of tubular pole 9. The top part 6 of shell 1 is therefore firmly but releasably secured to the top of hand-grip 7. Rotational movement of the shell 1 about the longitudinal axis of hand-grip 7 and pole 9 can be provided. The two shells of the pair may have an unsymmetrical shape to fit the left and right hands, or a unique shape to fit both hands. The inside of the shell has a metallised and reflective surface 13 (FIG. 4).

Figure 6:
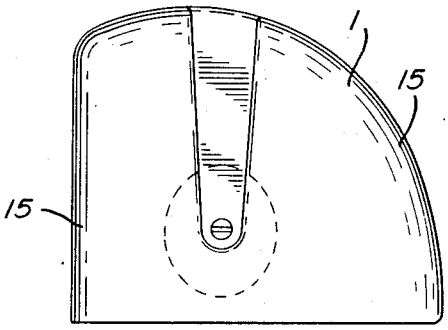
FIG. 6 is the top view of FIG. 5, showing the depression that forms the spacer member.
Figure 7:
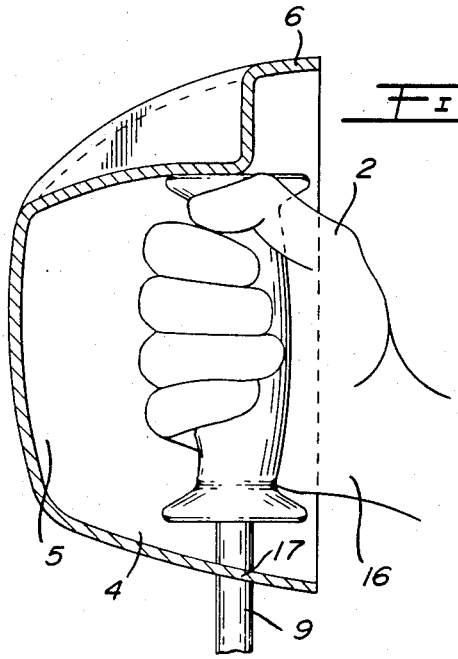
FIG. 7 is a side cross-sectional view, taken on line 7—7 of FIG. 5 and showing the vacuum-formed spacer member of the shell.

The second embodiment, shown in FIGS. 5 to 7, shows the unsymmetrical shape of shell **1*a* and also that separate spacer 3 is replaced by a spacer member 8 which is integral with shell 1*a* and is obtained by forming a central narrow depression which extends from front to back and having a bottom wall 8*a*, the rear end of which directly rests on top 10 of hand-grip 7 and is secured thereto by screw 14. The remaining portions of shell 1*a*** are similar to those of the first embodiment and bear like reference numerals.

Figure 8:
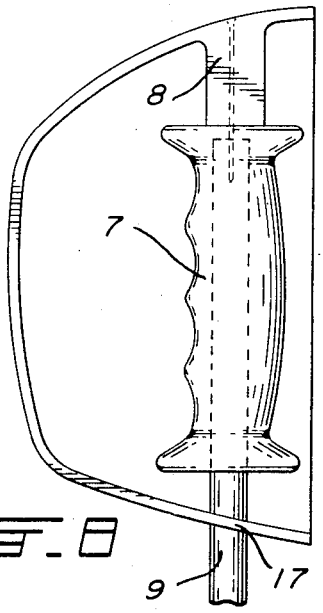
FIG. 8 is a cross-sectional view of a third embodiment of the shell with its spacer member integrally formed by injection moulding.

Shell **1*b* of the third embodiment, illustrated in FIG. 8, differs from the first embodiment in that separate spacer 3 is replaced by a spacer member 18 in the form of a stud, depending from and integrally formed with the top part 6 of shell 1*b***.

What I claim is:

1. A ski pole hand-shield for removable attachment to a ski pole and to a ski pole hand-grip of the type having a blind bore removably receiving the top end of said ski pole, said shield including a shell made of semi-rigid material and of a shape and size to cover and be spaced from the top, the front sides and the bottom of the gloved hand of a skier when clenched on said hand-grip, said shell having an inside surface covered by a coating which is metallised and reflective, a front part, a top part, a bottom part and side parts which form a hand access opening at the rear of said shell, said bottom part having a rearwardly-downwardly-slanted surface provided with a hole to slidably receive the ski pole below the hand-grip, said top part being forwardly and downwardly inclined and overlying the top end of said hand-grip, a spacer member interposed between said top end and said top part and formed by the bottom wall of a central, narrow depression integrally formed in said top part and running from front to back of said shell and fastening means to removably fix said top part and spacer member to said top end.

2. The hand-shield of claim 1, wherein said fastening means is a screw screwed in the top end of said hand-grip.

3. The handshield of claim 1, wherein said hole is split.

4. A ski pole including a rigid tube having a top end, a handle fixedly surrounding the upper portion of said tube, and a substantially semi-spherical semi-rigid casing mounted by mounting means to said tube concentrically thereto about said handle; said casing defining a main curved wall and an opened substantially oval mouth engageable by a ski pole user's gloved hand, the radius of said semi-spherical casing being large enough to spacedly accommodate said user's gloved hand closed on said handle; a heat-reflective layer coating the inner face of said curved wall; said mounting means including a clip, made about one peripheral edge portion of said curved wall to snap beneath said handle on said tube; and a narrow unturned offset, about an opposite peripheral edge portion thereof in register with said tube top end; said offset defining a first leg substantially parallel with said tube and a second leg radially outwardly extending from said tube orthogonally to said first leg; a shoulder defined by said second leg adjacent said first leg, said shoulder abuttable against said tube top end; and fastening means for fixedly releasably interconnecting said shoulder and said tube top end.

* * * * *